United States Patent [19]

Gorris

[11] Patent Number: 5,007,464

[45] Date of Patent: Apr. 16, 1991

[54] ELECTROMAGNETIC WEFT BRAKE

[75] Inventor: Joannes J. H. M. Gorris, Eindhoven, Netherlands

[73] Assignee: Sulzer Brothers Limited, Winterthur, Switzerland

[21] Appl. No.: 352,168

[22] Filed: May 15, 1989

[30] Foreign Application Priority Data

May 20, 1988 [CH] Switzerland ..... 01934/88

[51] Int. Cl.[5] ..... D03D 47/36

[52] U.S. Cl. ..... 139/455; 139/452; 139/435.5; 335/276; 66/219; 188/163

[58] Field of Search ..... 66/219; 139/450, 452, 139/435.5, 455, 194, 453; 242/147 M, 150 M, 149, 47.01; 112/154; 188/65.1, 171, 163, 161, 164; 335/276, 281, 279, 275

[56] References Cited

U.S. PATENT DOCUMENTS

| | | | |
|---|---|---|---|
| 2,952,801 | 9/1960 | Hyink | 335/281 X |
| 3,477,049 | 11/1969 | Kreidler | 335/276 |
| 3,563,026 | 2/1971 | Kreidler | 335/276 X |
| 3,812,691 | 5/1974 | Engelfried | 66/219 |
| 4,048,816 | 9/1977 | Scarffe | 66/219 |
| 4,282,724 | 8/1981 | Elsasser | 66/219 X |
| 4,515,186 | 5/1985 | Durville et al. | 66/219 |
| 4,641,688 | 2/1987 | Gehring | 139/450 |
| 4,817,681 | 4/1989 | Krumm et al. | 139/370.2 |

FOREIGN PATENT DOCUMENTS

| | | | |
|---|---|---|---|
| 0250359 | 4/1987 | European Pat. Off. . | |
| 2364680 | 7/1975 | Fed. Rep. of Germany . | |
| 1161662 | 9/1958 | France . | |
| 2597889 | 10/1987 | France . | |
| 7217620 | 6/1974 | Netherlands . | |
| WO88/01315 | 8/1987 | PCT Int'l Appl. . | |
| 448948 | 6/1936 | United Kingdom | 335/275 |

*Primary Examiner*—Andrew M. Falik

*Attorney, Agent, or Firm*—Kenyon & Kenyon

[57] ABSTRACT

An electromagnetic device is provided for use, for example, as a yarn brake, a rely nozzle valve, a weft yarn stretching nozzle and the like. The electromagnetic device has a pole piece associated with a winding connectable to an electric line. A spring strip is fixedly mounted at one end and projects over a curved abutment surface on the pole piece. In the absence of a magnetic field, the spring strip is disposed in spaced relation to the abutment surface. When a magnetic field builds up in the winding and the pole piece, the free end portion of the strip engages with the abutment surface of the pole piece along an increasing length, for example, to brake a yarn therebetween and, as the magnetic field intensifies, more and more zones of the spring strip engage the pole piece. Consequently, the initial speeds at which the strip moves at engagement and upon cessation of energization of the winding are relatively high.

17 Claims, 4 Drawing Sheets

ELECTROMAGNETIC WEFT BRAKE

This invention relates to an electromagnetic device for a loom. More particularly, this invention relates to an electromagnetic device which can be utilized in a yarn brake as well as in a relay nozzle valve.

As is known, looms of every kind include a large number of components which must be actuated on a cooperative basis, particularly with respect to yarn guidance. Such components include a weft yarn storage device which, in the case of air jet picking, may be followed by a yarn brake. Other components include relay nozzles which are necessary along a yarn path through a shed of warp yarns and stretching nozzles which are positioned at the end of a shed for the stretching of a weft yarn which has been picked.

All of the components noted above can be embodied by constructions which are relatively simple and which cooperate with one another fairly satisfactory. However, improvements in the operation of such components becomes necessary with looms which operate at high picking speeds.

It has also been known from German O.S. 2364680 to provide a yarn treatment device which is effective as a yarn brake and which operates electromagnetically. However, this device merely retains or releases the yarn and provides no deceleration, that is, slowing down, of the yarn movement.

European Patent Application 0250359 describes a weft yarn storage device which employs an electromagnetically operated clamping element which prevents yarn windings from being drawn off a drum of the storage device from time-to-time. However, the clamping element is able to take up only two defined end positions and cannot take up an intermediate position should such be required during the operation of the storage device.

Accordingly, it is an object of the invention to provide an electromagnetic device which permits a rapid change of position.

It is another object of the invention to provide an electromagnetic device which has several uses in a loom.

It is another object of the invention to provide a simple construction of an electromagnetic device which is able to take up an intermediate position as well as two defined end positions.

Briefly, the invention provides an electromagnetic device for a loom which is comprised of at least one pole piece having an abutment surface thereon, a winding for conducting an electrical current therethrough to generate an electromagnetic force in the pole piece and a spring strip mounted on one end on the pole piece and having a free end portion extending in spaced opposed relation to the abutment surface. The free end portion of the spring strip is movable between an extended position spaced from the abutment surface of the pole piece and a retracted position against the abutment surface of the pole piece in dependence on the electromagnetic force generated by the winding. For example, the spring strip is movable from the extended position towards the retracted position in response to energization of the winding. Thus, in the absence of a magnetic field, the spring strip is positioned in the extended position while being attracted into the retracted position in response to the occurrence of a magnetic field.

As the magnetic field increases, more and more zones of the spring strip engage the pole piece.

Both the spring strip and the pole piece may, of course be made of a material having magnetic properties.

The construction of the electromagnetic device is such that at least one of the abutment surface and the end portion of the spring strip is curved. Preferably, a straight spring strip is secured at one end to a curved abutment surface. When the winding is deenergized, the angle between the spring strip and the abutment surface is increased by the curvature of the abutment surface along the length of the spring strip. Upon energization of the winding, and if the spring strip is of considerable length, the strip experiences a relatively high electromagnetic force and is initially attracted rapidly because of the absence of any opposing force. However, the more the spring strip engages the curved abutment surface, the more the spring strip is bent and the more the strip develops opposing forces opposing the attracting electromagnetic force. When the winding is switched off, the spring strip is returned to the initial position, that is, the extended position, with a very high initial acceleration.

The main advantage of the electromagnetic device is therefor that the initial speeds at which the spring strip moves from both of the end positions are relatively high. Also, varying the voltage of the winding can produce different end positions of the strip on the pole piece.

While engagement of the spring strip on the abutment surface is retarded by the opposing forces, during switch-off of the winding, the spring strip returns to the initial position in an unbreaked manner. Accordingly, a damping strip is provided for damping the movement of the spring strip into the extended position. Such a damping strip may be made of rubber or a similar damping material.

In one embodiment, the damping strip is provided with a thin metal strip to increase the weight of the strip and to reduce bounce. In this case, a screening strip is also secured to and over the damping strip on a side opposite from the spring strip. The screening strip is also provided with an elongated slot in order to receive the thin metal strip secured to the damping strip.

One advantage of the electromagnetic device is that the spring strip mass which is to be moved is relatively reduced. Also, the spring rate and, therefore, spring strip movement can be controlled. Since the spring strip has a relatively large abutment area and is of reduced weight, the working life of the electromagnetic device is relatively large. Furthermore, the device can be constructed in a simple and low cost manner.

The electromagnetic device may be embodied in a yarn brake, particularly, for use at the end of a loom pick in order to prevent further windings of yarn from being drawn off a drum of a weft yarn storage device. To this end, the spring strip carries a locking pin at the end which projects from the strip to extend into a recess of the winding drum of a weft yarn storage device in order to limit the delivery of the yarn windings. For example, when the electrical winding is deenergized, the spring strip is in an operative extended position in the recess of the drum of the weft yarn storage device. Upon energization of the electrical winding, the spring strip is attracted into the retracted position thereby withdrawing the locking pin from the drum so that the required yarn windings are released very rapidly.

Likewise, upon deenergization of the electrical winding, the pin can be rapidly returned into the recess of the drum to prevent release of any further yarn windings.

The electromagnetic device may also be embodied in a relay nozzle valve for controlling a plurality of relay nozzles for guiding a weft yarn across a loom. In this embodiment, the device includes a frame for housing the pole piece, winding and spring strip in sealed relation. In addition, the frame is provided with an inlet orifice for a flow of pressurized air and an outlet orifice for exhausting a flow of pressurized air, for example, into a duct extending from the outlet orifice to a plurality of relay nozzles. In this case, a valve body is mounted on the spring strip for movement from a sealing position over the outlet orifice corresponding to the extended position of the spring strip, i.e. the deenergized state, to a release position spaced from the outlet orifice corresponding to the retracted position of the spring strip, i.e. the energized state of the electrical winding.

By appropriate adaptation of the winding voltage, the valve can be controlled very accurately via the disengagement of the valve body from the outlet orifice.

In another embodiment, the electromagnetic device may be incorporated into a yarn brake or into a weft yarn tip stretching nozzle on the catching side of a loom. For example, when used as a yarn brake, the electromagnetic device is housed within a frame such that the spring strip is able to abut against the frame when in the extended position in order to brake a yarn extending therebetween. Alternatively, the spring strip may be mounted so as to abut against the abutment surface of the pole piece in the retracted position in order to brake a yarn extending therebetween. Depending upon the voltage applied to the winding, the spring strip is deformed to a varying extent so that the braking effect on the yarn also varies. The yarn can therefore be braked in a manner which varies in time in accordance with a predetermined program.

Where the electromagnetic device is used as a yarn brake or weft yarn tip stretching nozzle, the companion surface which cooperates with the spring strip may be part of a casing, the screening strip or the damping strip as well as the abutment surface of the pole piece or an abutment surface of the frame.

These and other objects and advantages of the invention will become more apparent from the following detailed description taken in conjunction with the accompanying drawings wherein.

Figure 1:
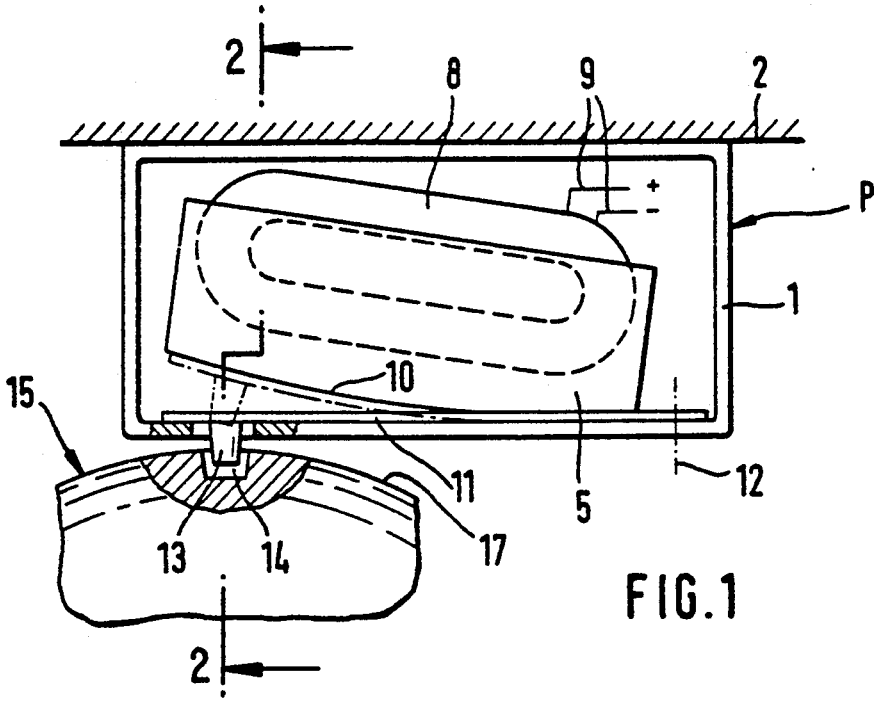
FIG. 1 illustrates a part cross sectional side view of an electromagnetic device in accordance with the invention for use with a weft yarn storage device.
Figure 2:
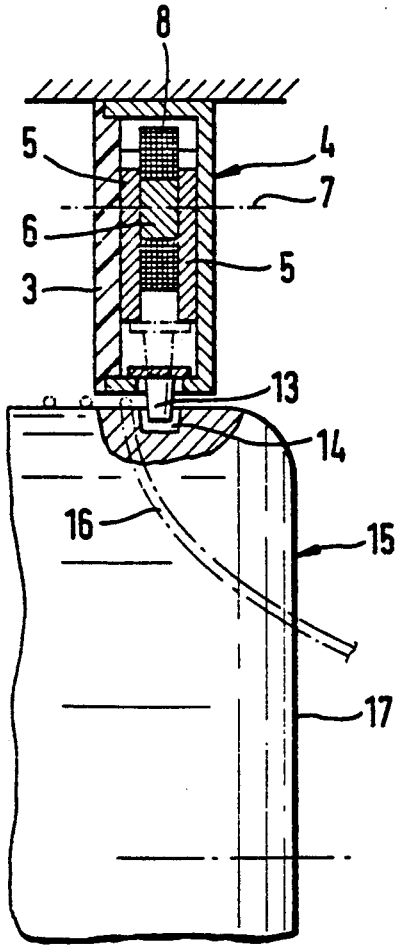
FIG. 2 illustrates a view taken on line II—II of FIG. 1.

Referring to FIGS. 1 and 2, the electromagnetic device P has a frame 1 secured to a frame 2 or support element, for example, for use in a loom (not shown). As illustrated in FIG. 2, the frame 1 may have an open side which is closed by a cover 3 so as to form a casing 4.

The electromagnetic device P includes a pair of pole pieces 5 which are fixedly mounted within the frame 1 and which are connected to each other and to the frame 1 by way of a core 6 and a connecting element 7 shown only in chain lines. An electrical winding 8 extends around the core 6 for conducting an electrical current therethrough in order to generate an electromagnetic force in the pole pieces 5. As indicated, the winding 8 is connected by way of corresponding lines 9 to a suitable power supply (not shown) or to a controller (not shown).

As indicated in FIG. 1, the pole pieces 5 each have a curved abutment surface 10. In addition, a spring strip 11 is fixed mounted at one end to the frame 1 by way of a corresponding securing element 2 shown only in chain-dotted line so as to be fixed relative to and against the pole pieces 5. In addition, the spring strip 11 has a free end portion which extends in spaced opposed relative to the abutment surface 10 of the pole pieces 5. This free end portion of the spring solid line, spaced from the abutment surface 10 and a retracted position (shown in dotted line) against the abutment surface in dependence on the electromagnetic force generated by the electrical winding 8.

When used as a yarn brake, the electromagnetic device has a pin 13 projecting from the end portion of the spring strip 11 to extend into a recess 14 in a winding drum 17 of a weft yarn storage device 15 in order to limit the delivery of yarn windings of a yarn 16 therefrom. With the electromagnetic device P deenergized, the locking pin 13 engages in the recess 14 of the storage device 15. In this position, the pin 13 prevents further windings of the yarn 16 from being drawn off the drum 17. When the electromagnetic device is energized, the pin 13 is rapidly withdrawn from the recess 14 to permit the yarn windings to be delivered from the drum 17. The pin 13 therefore controls the start and finish of the drawing off of the yarn windings.

Referring to FIG. 1, when the winding 8 is energized by way of the electrical lines 9, a magnetic field arises at the pole pieces 5 and attracts the strip 11 over the whole length of the free portion. Thus, the engagement of the strip 11 with the pole pieces 5 is tangential and stepwise. Because of the curvature of the pole pieces 5, an opposing force builds up over the free length of the strip 11. Initially, the entire magnetic force acting on the strip 11 is relatively high because of the length of the strip 11, particularly since the opposing force produced by the bending of the strip 11 is relatively small. The exit of the pin 13 from the recess 14 can, therefore, be greatly accelerated. Towards the end of the step of engaging the strip 11 with the abutment surface 10, however, a high opposite force must be overcome because of the bending of the strip 11. In this case, the electromagnetic force must be considerably increased. Advantageously, the electromagnetic force is such as to be in balance with the opposing force of the strip 11 when the strip 11 is fully engaged on the surfaces 10 of the pole pieces 5.

Upon cessation of the electromagnetic force, the opposing forces in the spring strip are available due to the resilient deformation of the strip 11. Thus, the strip 11 is returned to the normal extended position under considerable acceleration. Therefore, the braking of the yarn windings from the winding drum 17 can be instituted rapidly.

The pole pieces 5 may be made relatively thin so that a rapid magnetic induction is possible therethrough.

Figure 3:
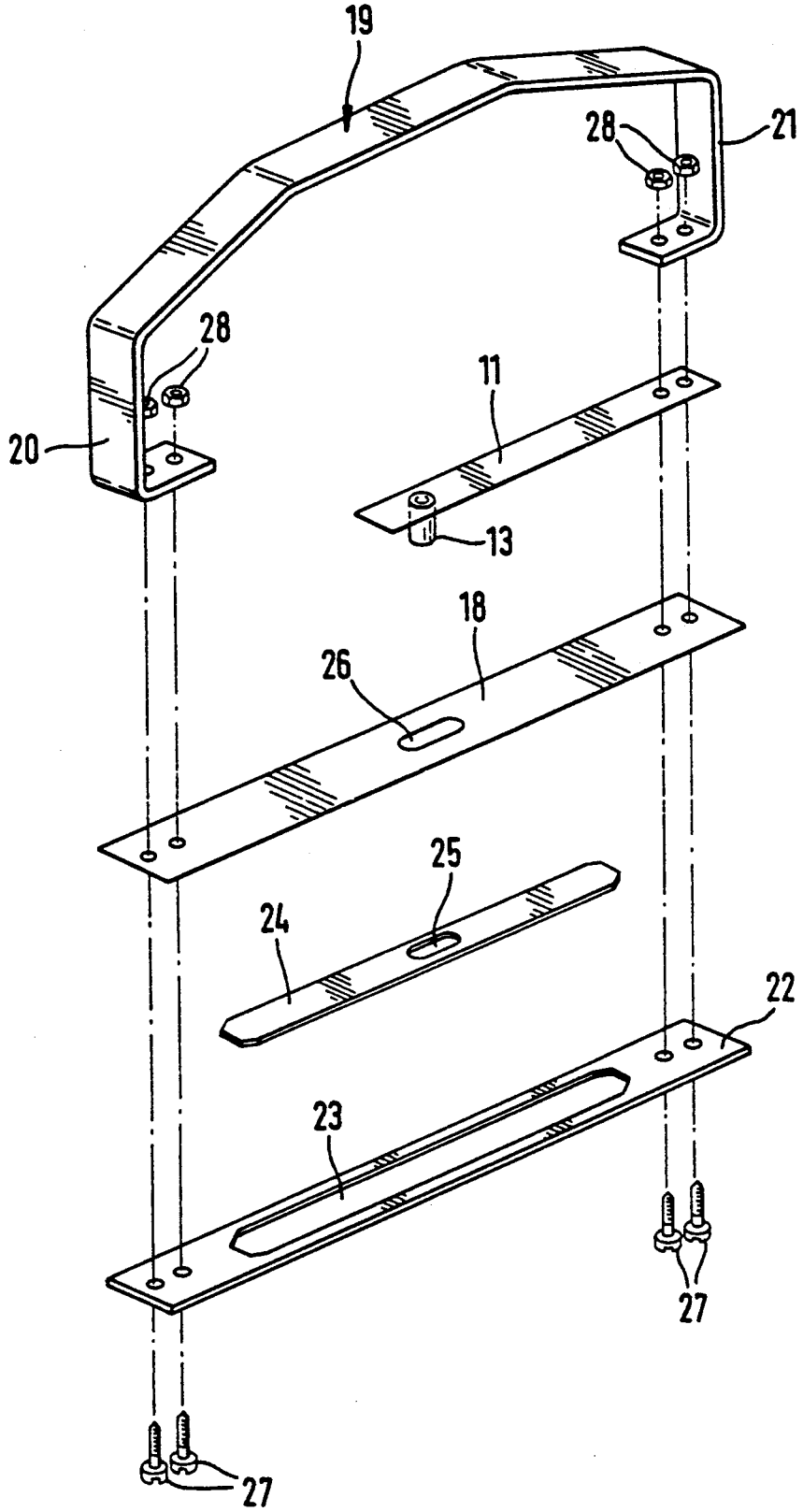
FIG. 3 illustrates an exploded view of a frame for mounting a spring strip of an electromagnetic device in accordance with the invention.

Referring to FIG. 3, wherein like reference characters indicate like parts as above, the spring strip 11 may be mounted in a frame formed of a U-shaped spacing and assembly stirrup 19. The stirrup 19 has a pair of free arms 20, 21 which are interconnected by a screening strip 22 provided with a very fine and wear resistant finish on the underside. In addition, the strip 22 is formed with an elongated slot 23.

As illustrated, the spring strip 11 is secured to one arm 21 of the stirrup 19. In addition, a damping strip 18 is secured across the arms 20, 21 on a side opposite the spring strip 11 for damping the movement of the spring strip 11 into the normal extended position in response to deenergization of a winding (not shown). A thin metal strip 24 is also secured to the damping strip 18 in order to increase the weight of the damping strip 18 and to reduce bounce of the spring strip 11 during a return movement. As indicated, the metal strip 24 is sized to pass into the slot 23 of the screening strip 22. In this respect, the underside of the metal strip 24 is provided with a fine and wear-resistant finish. The strip 24 may be vulcanized to the damping strip 18.

As indicated, the strips 11, 18, 22 are secured to the free ends 20, 21 of the stirrup 19 by means of bolts 27 and nuts 28. Also, the metal strip 24 is provided with a slot 25 and the damping strip 18 is provided with a corresponding slot 26 for passage of the pin 13 extending from the spring strip 11.

Figure 4:
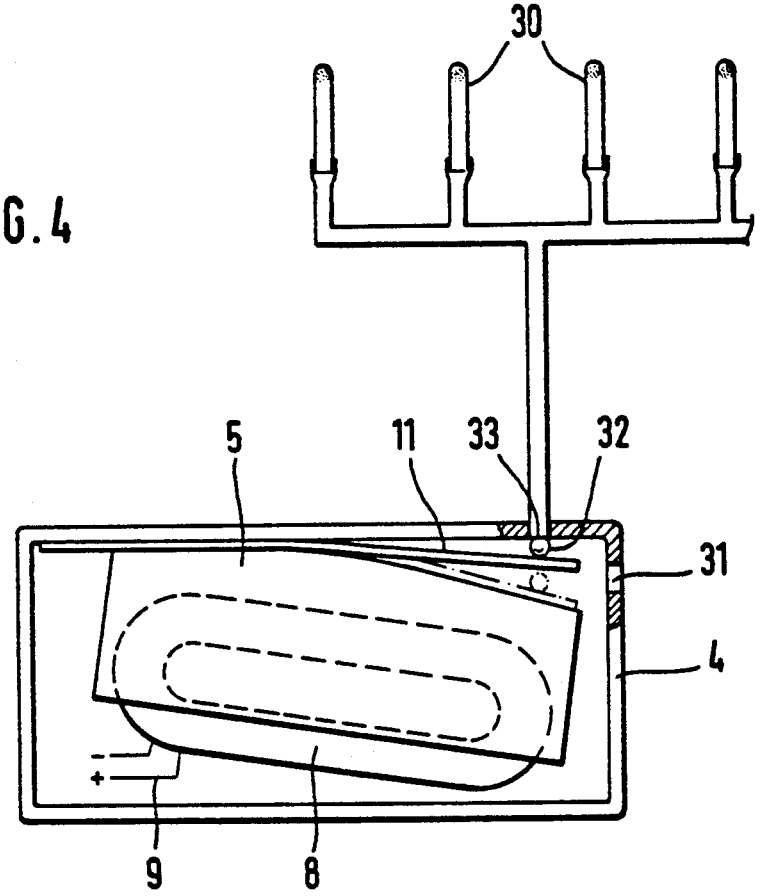
FIG. 4 illustrates a view of an electromagnetic device embodied in a relay nozzle valve in accordance with the invention.

Referring to FIG. 4, the electromagnetic device may be used as a valve for a plurality of relay nozzles 30, for example, for guiding a weft yarn across a loom. In this regard, the frame 4 houses the pole pieces 5, winding 8 and spring strip 11 in sealed relation. In addition, the frame 4 is provided with an inlet orifice 31 for a flow of pressurized air, such as compressed air, as well as an outlet orifice 33 for exhausting a flow of pressurized air. Further, a valve body 32 in the form of a ball is mounted on the spring strip 11 for movement from a sealing position over the outlet orifice 33 corresponding to the extended position of the spring strip 11 to a release position spaced from the outlet orifice 33 corresponding to the retracted position of the spring strip 11.

As shown in FIG. 4, a duct (unnumbered) extends from the outlet orifice 33 and is connected to the relay nozzles 30 to deliver pressurized air thereto.

With the spring strip 11 in the extended position, the relay valve prevents a flow of compressed air to the relay nozzles 30. However, upon energization of the winding 8, the spring strip 11 moves towards the retracted position shown in dotted lines so that the ball 32 moves away from the outlet orifice 33 so that a flow of compressed air can be delivered to the relay nozzles 30 which are disposed along a weft yarn passage within a shed of warp yarns.

Figure 5:
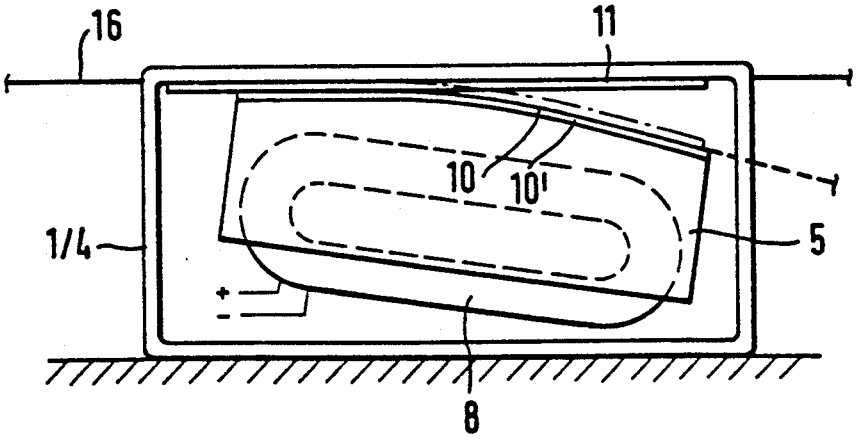
FIG. 5 illustrates a modified embodiment of an electromagnetic device constructed as a yarn brake in accordance with the invention.
Figure 7:
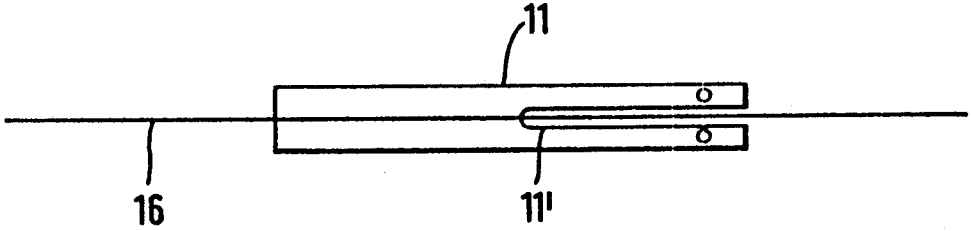
FIG. 7 illustrates a plan view of a spring strip constructed in accordance with the invention.

Referring to FIG. 5, wherein like reference characters indicate like parts as above, the electromagnetic device may also be used as a yarn entry brake for a weft yarn 16. In this respect, two variations are possible. In the first case, the yarn 16 may be guided as indicated by a solid line into and through the frame 1 and along the top inside surface, as viewed, of the frame 1 while being braked by the spring strip 11. That is, in this embodiment, the spring strip 11 abuts against the frame 1 when in the extended position in order to brake the yarn 16 extending therebetween. In this case, the spring strip 11 is formed as indicated in FIG. 7 so that the end of the strip 11 which is fixed to the frame 1 is bifurcated so as to define a slot 11' through which the yarn 16 may be guided. The solid free end portion of the strip 11 then serves as a braking surface when abutted against the frame 1. When the spring strip 11 is attracted, the yarn is able to pass through the slot 11'.

In a second embodiment, as indicated in chain lines, the spring strip 11 is abutted against the abutment surfaces of the pole pieces 5 in the retracted position in order to brake the yarn 16 extending therebetween. In this case, the yarn is braked against a pole piece 5 upon energization of the winding 8.

Figure 6:
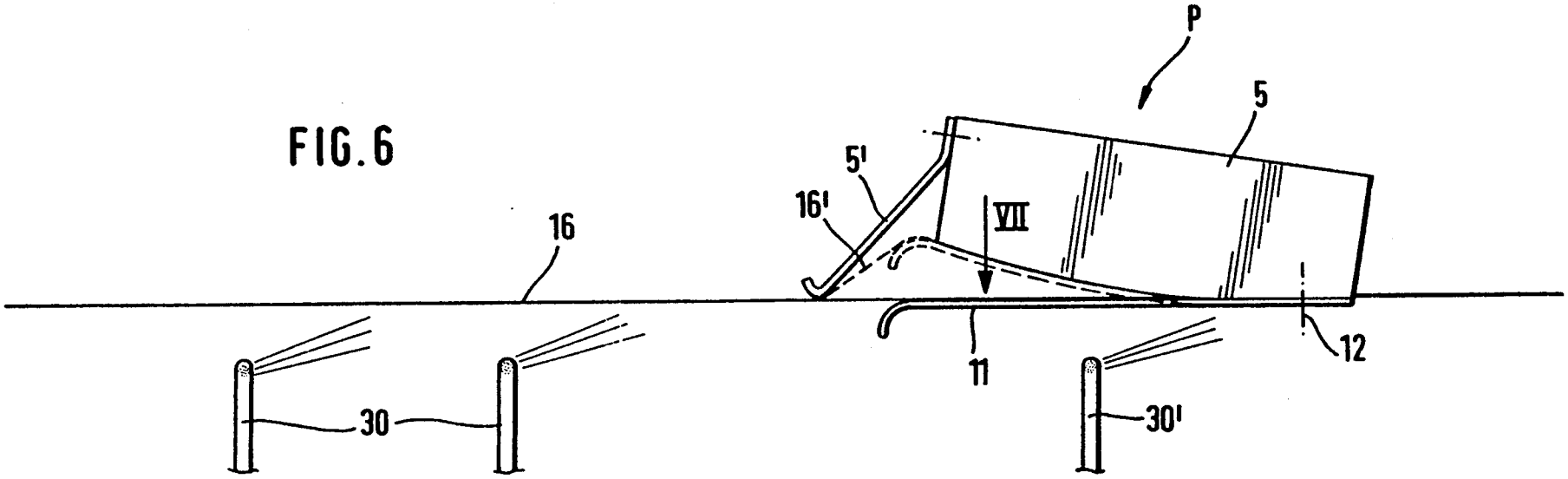
FIG. 6 illustrates a schematic view of a further embodiment of an electromagnetic device employed as a stretching device for a picked yarn.

Referring to FIG. 6, wherein like reference characters indicate like parts as above, the electromagnetic device may be used for stretching a weft yarn 16 after picking. In this case, a yarn deflecting element 5' projects from the pole pieces 5 in line with the free end portion of the spring strip 11 in order to deflect a yarn 16' thereabout upon movement of the spring strip 11 into the retracted position braking the yarn between the strip 11 and at least one of the pole pieces 5. Initially, the weft yarn 15 is disposed in an extended position along the yarn brake between the spring strip 11 and the pole pieces 5. In this respect, the spring strip 11 is bifurcated as indicated in FIG. 7 for guiding the yarn 16 thereby. When the strip 11 engages the pole pieces 5, the yarn moves into the position 16, between the deflecting element 5' and the spring strip 11. The yarn 16 is thus given an additional stretching. As indicated in FIG. 6, relay nozzles 30 are provided for guiding the weft yarn 16 past the electromagnetic device P. An additional nozzle 30' is provided to facilitate the entry of the yarn 16 into the slot 11' (see FIG. 7) of the spring strip 11.

The invention thus provides an electromagnetic device which can be used as a yarn brake as well as a relay nozzle valve within a loom. In particular, the invention provides an electromagnetic device which can be moved between two end positions as well as into an intermediate position.

The invention further provides an electromagnetic device which has a rapid response time. In this respect, the initial movement of the spring strip from an extended position to a retracted position occurs with a initial high acceleration. In addition, the spring strip can be returned to an extended position with a rapid acceleration during an initial stage.

What is claimed is:

1. In combination, a winding drum for a loom for receiving yarn windings thereon; and an electromagnetic device for limiting delivery of yarn windings from said drum, said device having at least one pole piece having an abutment surface thereon; a winding for conducting an electrical current therethrough to generate an electromagnetic force in said pole piece; and a spring strip fixedly mounted at one end relative to said pole piece and having a free end portion extending in spaced opposed relation to said abutment surface, said free end portion of said spring strip being movable between an extended position spaced from said abutment surface to limit delivery of yarn windings from said drum and a retracted position against said abutment surface in dependence on said electromagnetic force to allow delivery of yarn windings from said drum, at least one of said abutment surface and said end portion of said spring strip being curved.

2. An electromagnetic device as set forth in claim 1 wherein said end portion of said strip is movable from said extended position towards said retracted position in response to energization of said winding.

3. An electromagnetic device as set forth in claim 2 which further comprises a damping strip secured to one end of said spring strip on a side opposite said pole piece for damping the movement of said spring strip into said extended position in response to deenergization of said winding.

4. An electromagnetic device as set forth in claim 3 which further comprises a screening strip secured to and over said damping strip on a side opposite said spring strip and having an elongated slot therein; and a thin metal strip secured to said damping strip to increase the weight thereof and reduce bounce, said metal strip being sized to pass into said slot.

5. An electromagnetic device as set forth in claim 4 which further comprises a pin projecting from said end portion of said spring strip through said damping strip, said metal strip and said screening strip to extend into a recess of said winding drum to limit the delivery of yarn windings therefrom.

6. An electromagnetic device as set forth in claim 1 which further comprises a pin projecting from said end portion of said spring strip to extend into a recess of a winding drum of a weft yarn storage device to limit the delivery of yarn windings therefrom.

7. An electromagnetic device as set forth in claim 1 further comprising a yarn deflecting element projecting from said pole piece in line with said free end portion of said spring strip to deflect a yarn thereabout upon movement of said spring strip into said retracted position to brake the yarn between said strip and said pole piece.

8. An electromagnetic device as set forth in claim 7 wherein said strip is bifurcated along a portion secured to said pole piece to pass a yarn therethrough.

9. A yarn brake comprising a frame;

at least one pole piece mounted in said frame and having an abutment surface thereon;

a winding for conducting an electrical current therethrough to generate an electromagnetic force in said pole piece;

a spring strip fixedly mounted at one end relative to and against said pole piece and having a free end portion extending in spaced opposed relation to said abutment surface, said free end portion of said spring strip being movable between an extended position spaced from said abutment surface and a retracted position against said abutment surface in dependence on said electromagnetic force; and a pin projecting from said end portion of said spring strip to extend into a recess of a winding drum of a weft yarn storage device to limit the delivery of yarn windings therefrom.

10. A yarn brake as set forth in claim 9 wherein said spring strip abuts against said frame in said extended position to brake a yarn extending therebetween.

11. A yarn brake as set forth in claim 9 wherein said spring strip abuts against said abutment surface of said pole piece in said retracted position to brake a yarn extending therebetween.

12. An electromagnetic device for a loom comprising at least one pole piece having an abutment surface thereon;

a winding for conducting an electrical current therethrough to generate an electromagnetic force in said pole piece;

a spring strip fixedly mounted at one end relative to said pole piece and having a free end portion extending in spaced opposed relation to said abutment surface, said free end portion of said spring strip being movable between an extended position spaced from said abutment surface and a retracted position against said abutment surface in dependence on said electromagnetic force;

a frame housing said pole piece, winding and spring strip in sealed relation, said frame having an inlet orifice for a flow of pressurized air and an outlet orifice for exhausting a flow of pressurized air; and a valve body mounted on said spring strip for movement from a sealing position over said outlet orifice corresponding to said extended position of said spring strip to a release position spaced from said outlet orifice and corresponding to said retracted position of said spring strip.

13. An electromagnetic device as set forth in claim 12 further comprising a duct extending from said outlet orifice and connectable to a plurality of relay nozzles to deliver pressurized air thereto for guiding a weft yarn across a loom.

14. A yarn brake comprising a frame;

at least one pole piece mounted in said frame and having an abutment surface thereon;

a winding for conducting an electrical current therethrough to generate an electromagnetic force in said pole piece; and a spring strip having a bifurcated portion fixedly mounted at one end to said pole piece to pass a yarn therethrough and having a free end portion extending in spaced opposed relation to said abutment surface, said free end portion of said spring strip being movable between an extended position spaced from said abutment surface and a retracted position against said abutment surface in dependence on said electromagnetic force.

15. A yarn brake comprising a frame;

at least one pole piece mounted in said frame and having an abutment surface thereon;

a winding for conducting an electrical current therethrough to generate an electromagnetic force in said pole piece;

a spring strip fixedly mounted at one end relative to said pole piece and having a free end portion extending in spaced opposed relation to said abutment surface, said free end portion of said spring strip being movable between an extended position spaced from said abutment surface and a retracted position against said abutment surface in dependence on said electromagnetic force; and a yarn deflecting element projecting from said pole piece in line with said free end portion of said spring strip to deflect a yarn thereabout upon movement of said spring strip into said retracted position to brake the yarn between said strip and said pole piece.

16. In combination a winding drum for receiving yarn windings; and a yarn brake for limiting delivery of yarn windings from said drum, said device having a frame, at least one pole piece mounted in said frame and having an abutment surface thereon, a winding for conducting an electrical current therethrough to generate an electromagnetic force in said pole piece, and a spring strip fixedly mounted at one end relative to said pole piece and having a free end portion extending in spaced opposed relation to said abutment surface, said free end portion of said spring strip being movable between an extended position spaced from said abutment surface for limiting delivery of yarn windings from said drum and a retracted position against said abutment surface in dependence on said electromagnetic force to allow delivery of yarn windings from said drum.

17. The combination as set forth in claim 16 which further comprises a pin projecting from said end portion of said spring strip to extend into a recess of said winding drum to limit the delivery of yarn windings therefrom.

* * * * *

UNITED STATES PATENT AND TRADEMARK OFFICE

CERTIFICATE OF CORRECTION

PATENT NO. : 5,007,464

DATED : April 16, 1991

INVENTOR(S) : JOANNES J.H.M. GORRIS

It is certified that error appears in the above-identified patent and that said Letters Patent is hereby corrected as shown below:

Column 2, line 26 change "therefor" to -therefore-
Column 2, line 34 change "unbreaked" to -unbraked-
Column 2, line 52 change "large" to -long-
Column 4, line 19 change "fixed" to -fixedly-
Column 4, line 23 and 24 change "relative" to -relation-
Column 4, line 25 "spring solid" to -spring strip 11 is movable between an extended position, as shown in solid-
Column 6, line 29 change "16" to -16'-
Column 6, line 45 change "a" (second occurrence) to -an-
Column 7, line 28 change "a" (second occurrence) to -said-
Column 7, line 30 cancel "of a weft yarn storage device"

Signed and Sealed this

Seventeenth Day of November, 1992

*Attest:*

DOUGLAS B. COMER

*Attesting Officer*

*Acting Commissioner of Patents and Trademarks*